United States Patent [19]

Haulsee et al.

[11] Patent Number: 4,581,915

[45] Date of Patent: Apr. 15, 1986

[54] HYDRAULIC CUP HOLDER

[75] Inventors: Donald R. Haulsee, Chesterfield County; Melvin Vergales, Henrico County, both of Va.

[73] Assignee: Reynolds Metals Company, Richmond, Va.

[21] Appl. No.: 635,160

[22] Filed: Jul. 27, 1984

[51] Int. Cl.[4] ..... B21D 22/00

[52] U.S. Cl. ..... 72/349; 72/351

[58] Field of Search ..... 72/347, 348, 349, 350, 72/351

[56] References Cited

U.S. PATENT DOCUMENTS

| | | | |
|---|---|---|---|
| 1,778,358 | 10/1930 | Glasner . | |
| 2,318,819 | 5/1943 | Verson | 113/46 |
| 3,453,848 | 7/1969 | Williamson | 72/349 |
| 3,636,748 | 1/1972 | Hall | 72/349 |
| 3,751,962 | 8/1973 | Cvacho et al. | 72/347 |
| 3,786,667 | 1/1974 | Garnett, Jr. | 72/348 |
| 3,940,968 | 3/1976 | Hermes | 72/349 |
| 4,020,670 | 5/1977 | Bulso | 72/349 |

*Primary Examiner*—Leon Gilden

*Attorney, Agent, or Firm*—Alan T. McDonald

[57] ABSTRACT

A hydraulic cup holder for use in a draw and iron can making press is disclosed. This cup holder produces increased pressure between the cup being reformed and its holding members, reducing the tendency for wrinkles to occur in reforming the cup into a can body.

4 Claims, 2 Drawing Figures

HYDRAULIC CUP HOLDER

BACKGROUND OF THE INVENTION

The draw and iron (D&I) process for forming one-piece metallic can bodies, notably can bodies formed from aluminum alloys and steel, has become the dominant method for producing beverage containers for such products as beer and soft drinks.

In this process, circular blanks are punched from sheet metal and drawn into shallow cups in a first apparatus, commonly known as a cup maker.

These cups are then fed to a second apparatus, called a body maker or D&I press, where the cups are reformed by redrawing and ironing into their final container shape.

Subsequently, the container bodies are trimmed, necked and flanged to their final size.

In a continuing effort to reduce metal usage, weight and cost of the containers, container bodies have been designed to enable the containers to be formed from thinner sheet metal. For example, at one time aluminum alloy cans were formed from sheet metal having a thickness of about 0.015". More recently, however, these containers are being formed from metal as thin as 0.0129".

The decreased metal thickness, coupled with the increasing complexity of the bottom structure required for sufficient strength in the can, has led to a problem in can formation. The shallow cups entering the body maker are mechanically held against the leading edge of a redraw die by a cup holder positioned within the cup. A punch member passes through the cup holder, carrying the cup through the redraw die and a series of ironing dies, with the punch bottoming on a bottom former which, with the punch, forms the bottom surface structure of the container. The decreased metal thickness, coupled with the increased bottom structure complexity of modern cans, has produced wrinkles in the bottom structure of the container, due to slippage of the metal during the redraw operation.

The known mechanical cup holders are limited in the pressure they can apply to the cup against the redraw die. This limitation results from the length of axial movement required for the cup holder unit, as well as the stresses placed on the cup holder unit by its mechanical linkages.

It is thus a primary objective of the present invention to provide an improved cup holder mechanism for a can making body press which is capable of increasing the holding pressure of the cup holder during redrawing of the cup, thereby reducing substantially or eliminating wrinkles in the metallic containers formed therefrom.

THE PRESENT INVENTION

By means of the present invention, these desired objectives are obtained.

The apparatus of the present invention comprises a cup holder unit for use in a can body making press formed as inner and outer sleeves. The outer sleeve is mechanically linked to and timed with the punch of the press. The inner sleeve, which has attached thereto the cup holder, is slideably mounted for axial movement within the outer sleeve. Movement of the inner sleeve within the outer sleeve is hydraulically controlled, with the hydraulic pressure supplying the pressure to hold the cup between the cup holder and the redraw die.

BRIEF DESCRIPTION OF THE DRAWINGS

The apparatus of the present invention will be more fully described with reference to the FIGURES in which.

DETAILED DESCRIPTION OF THE PREFERRED EMBODIMENTS

Figure 1:
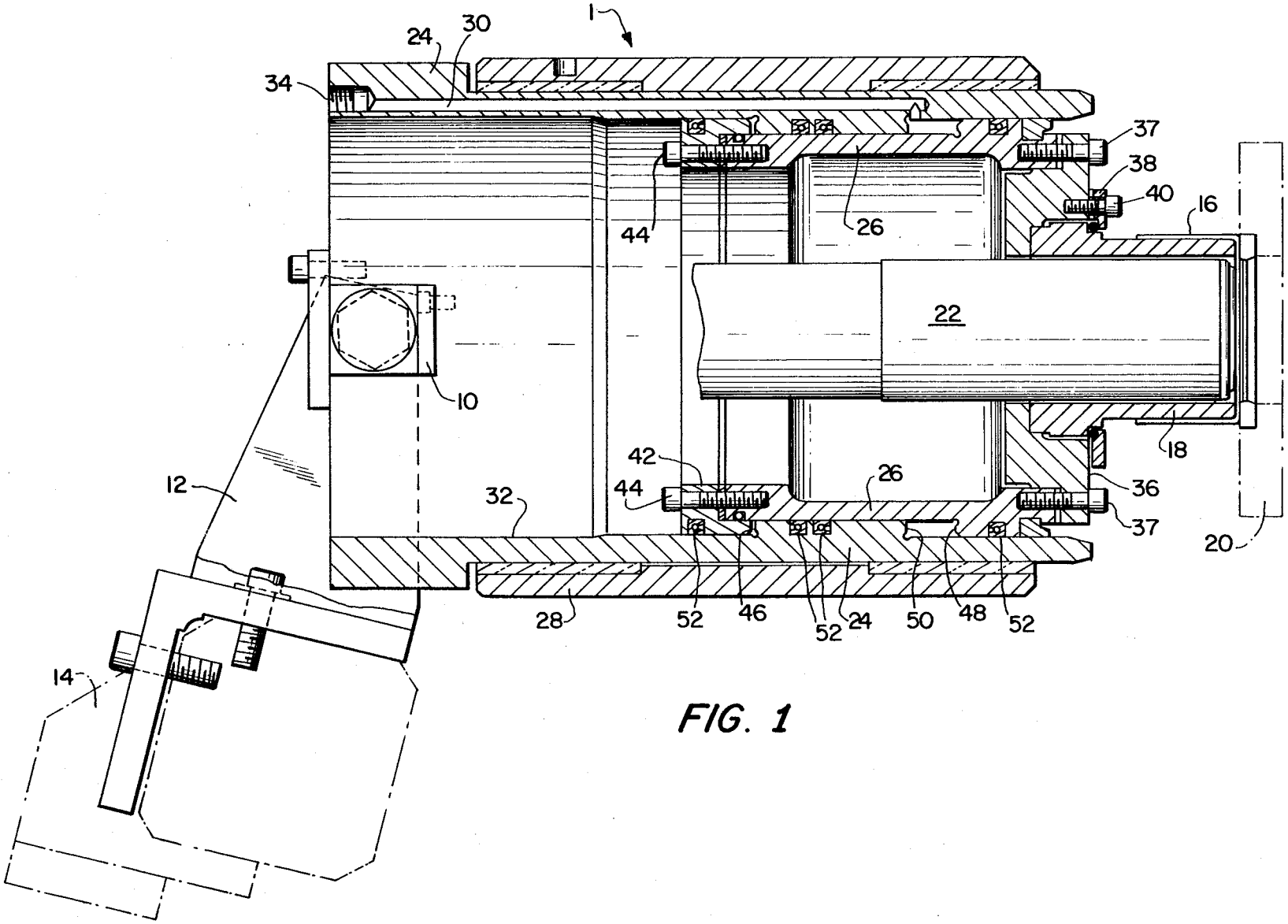
FIG. 1 is a cross-sectional view of the cup holder mechanism of the present invention.

Turning now to the FIGURES, the cup holder unit of the present invention is shown in cross-sectional view in FIG. 1. The cup holder unit, identified generally as 1, is mounted for axial movement within a can body maker press (not shown), such as that shown in U.S. Pat. No. 3,751,962, the disclosure of which is incorporated herein by reference, and is mounted by means of mounting 10 to mounting bracket 12, which is in turn mounted through mounting 14 to a source of driving motion for the cup holder unit 1. Thus, through normal mechanical linkage to a motor means (not shown), cup holder unit 1 moves along its axis. As shown, cup holder unit 1 is in its forwardmost position, with a cup 16 being firmly held between a cup holder 18 and the entrance surface to a redraw die 20. During operation of the D&I press, cup holder unit 1 moves axially rearwardly, permitting cups 16 to be positioned in front of cup holder 18 and the unit 1 moves axially forwardly to hold cup 16 in place for redrawing. A punch 22 is mounted along the same axis as cup holder unit 1 and is timed in its movement with cup holder unit 1 by being mechanically linked to the same driving force for the press. As illustrated, punch 22 is moving axially forwardly and is about to force cup 16 through the redraw die 20. In the container-making press, punch 22 would next force the redrawn cup 16 through a series of ironing dies and against a bottom former, all of which are common in the art and not illustrated. Punch 22, at the completion of the formation of a container body, moves axially rearwardly, providing space for a new cup 16 to fall into position.

The cup holder unit 1 comprises an outer sleeve member 24 and an inner sleeve member 26. The outer sleeve member 24 may include an outer casing 28. The outer sleeve 24 also includes a pair of fluid passageways 30 and 32 therewithin. These passageways 30 and 32 are connected to a source of hydraulic fluid, for purposes that will be shown below, such as by boring 34 in fluid communication with chamber 30 and a similar boring (not shown) in fluid connection with chamber 32.

Inner sleeve 26 has mounted thereto, by means of mounting member 36, face place 38 and bolts 37 and 40, the cup holder 18. Additionally, inner sleeve 26 has mounted at the rear thereof back plate 42, which is bolted thereto by means of bolts 44. Thus, inner sleeve 26 is slideably mounted within outer sleeve 24, within the distances permitted by contact between back plate 42 and stop surface 46 of outer sleeve 24 in the forward direction and stop surface 48 of inner sleeve 26 and stop surface 50 of outer sleeve 24 in the rearward direction. A plurality of fluid seals 52 are positioned between the sliding surfaces of sleeves 24 and 26, to prevent leakage of hydraulic fluid through the system, as will be described below.

When hydraulic fluid under pressure is applied through boring 34 to chamber 30, the fluid forces inner sleeve 26 forward, to the position shown in FIG. 1, and as restricted by stop surface 46 and back plate 42. Likewise, when pressurized hydraulic fluid is applied through chamber 32, inner sleeve 26 is forced rearwardly, with its rearward movement limited by stop surfaces 48 and 50.

Figure 2:
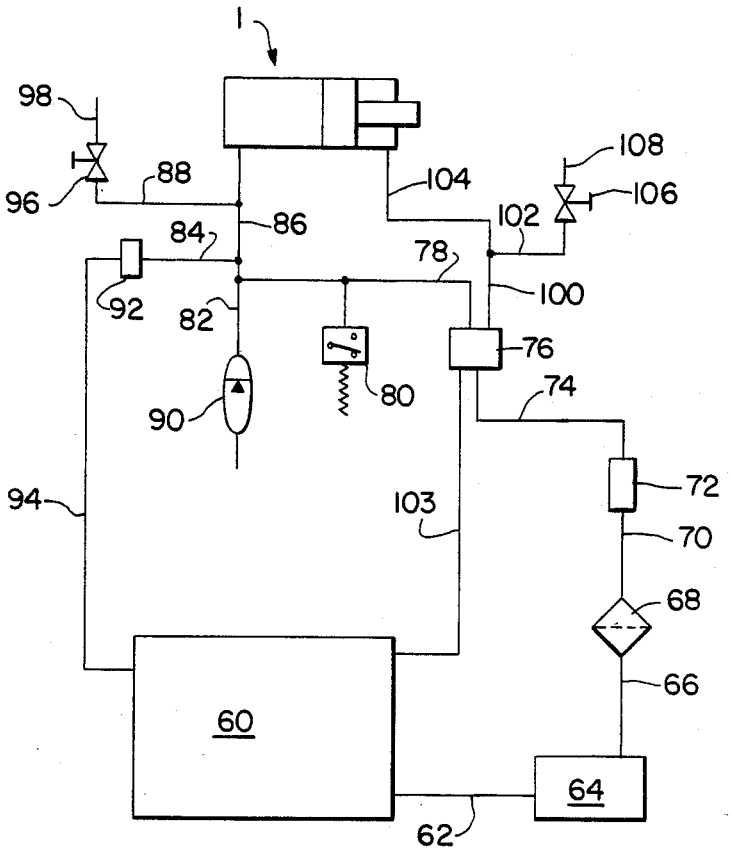
FIG. 2 is a schematic drawing of the hydraulic system employed in the present invention.

The hydraulic mechanism for operating the cup holder unit 1 is illustrated in FIG. 2. A sump 60 containing hydraulic fluid, such as oil, has its hydraulic fluid pumped therefrom through line 62 by means of a pump 64. Pump 64 forces the hydraulic fluid through line 66 and through an in-line hydraulic filter 68, which filter preferably filters out particles 10 microns or more in size. The hydraulic fluid next passes through line 70 to a one-way valve 72, which prevents hydraulic fluid from flowing backwardly through line 70, to maintain the hydraulic pressure in the system. The fluid continues its passage through line 74 and to a solenoid valve 76. The solenoid valve 76, when given the proper signal, connects line 74 with line 78 and line 100 with line 103 to transfer hydraulic fluid from chamber 32 to sump 60, with the hydraulic fluid in line 78 passing a pressure switch 80 and flowing through lines 82, 84, 86 and 88, with line 86 being connected to inlet 34 of cup holder unit 1. Connected at the end of line 82 is a pressure accumulator 90, which controls the pressure of the fluid throughout the system, and which is adjusted, such as by pressurized nitrogen, to pressurize the system to a pre-selected level. Pressure switch 80 is set to the pre-selected pressure level for the system, which may range from about 200 to about 2,000 pounds per square inch, and, if pressure switch 80 sees an excess pressure, opens pressure relief valve 92, permitting hydraulic fluid to pass through line 94 to sump 60, relieving the pressure within the system. Purge valve 96 is also provided to permit the hydraulic fluid within the system to be drained from the system through line 98.

As described above, line 86 is connected to inlet 34. Thus, as illustrated, the hydraulic system is acting to move the inner sleeve 26 to its forewardmost position, as illustrated in FIG. 1. This will, of course, force hydraulic fluid which may be in chamber 32 out through its inlet to its connection with line 104 and to lines 102, 100 and 103. No fluid may pass in the reverse direction from line 78 and line 74 through one-way check valve 72, acting to maintain the pressure of the system.

When it is desired to retract inner sleeve 26, solenoid valve 76 is given a signal and connects line 74 with line 100 and line 78 with line 103. In this manner, hydraulic fluid passes through lines 100, 102 and 104, and from line 104 into chamber 32, forcing sleeve 26 rearwardly, until stop surfaces 48 and 50 are in contact. Hydraulic fluid passing from chamber 30 to inlet 34 and into lines 86 and 78 pass through line 103, which is now connected to line 78, and into sump 60. Purge valve 106, connected to line 102, permits hydraulic fluid to exit the system through line 108 when required.

In operation of the can making press, inner sleeve 26 is maintained in its forwardmost position, as shown in FIG. 1, throughout the can making process. Accumulator 90 is pressurized to provide an eternal pressure ranging between about 250 and 2,000 pounds per square inch, which when applied to surface 48 of inner sleeve 26, results in a force which may range between about 1,000 and 10,000 pounds. This is in contrast to the prior mechanical system, which was capable of a maximum of about 1,700 pounds of force.

The body maker is adjusted such that the forwardmost stroke of the cup holder unit 1 by its mechanical linkage through brackets 12 and 14, attempts to force cup holder unit 1 a slight distance forward in excess of that which is possible due to the positioning of the cup 16 between cup holder 18 and redraw die 20, for example, about 0.015". The inner sleeve 26 will move backwardly that amount, against the hydraulic pressure in the unit 1, transferring this force to cup holder 18 and firmly holding cup 16 against redraw die 20. As this occurs, punch 22 moves forward, pulling cup 16 through redraw die 20, with the metal at the bottom of cup 16 wrapping about the nose of punch 22 without slippage or wrinkling thereof.

The only time that it is necessary to retract inner sleeve 26 is when maintenance is required on the body maker, such as if a jam or other mechanical problem occurs in the system. In that case, solenoid valve 76 reverses the hydraulic fluid flow in the system, forcing inner sleeve 26 rearwardly.

From the foregoing, it is clear that the present invention provides an effective means for reducing wrinkles in the formation of can bodies from shallow cups, which means are notable for their few moving parts and relative short movement of these parts.

While the invention has been described with reference to certain specific embodiments thereof, it is not intended to be so limited thereby, except as set forth in the accompanying claims.

We claim:

1. A cupholder for use in a can making machine, said cupholder comprising an outer sleeve member, an inner sleeve member sidably mounted within said outer sleeve member, a cup-holder member carried by said inner sleeve member, and hydraulic means for controlling the position of said inner sleeve member within said outer sleeve member and for providing a constant hydraulic force to said cupholder member, said hydraulic means comprising a pair of hydraulic fluid channels positioned within said outer sleeve member and communicating with fluid passageways between said outer sleeve member and said inner sleeve member, a source of hydraulic fluid, a pump, valve means for directing said hydraulic fluid to said fluid channels and means for controlling hydraulic fluid pressure at a constant, pre-selected level to provide said constant hydraulic force.

2. The cupholder of claim 1 wherein said means for controlling hydraulic fluid pressure level comprises a pressurized accumulator, a pressure switch and a pressure release valve.

3. The cupholder of claim 1 wherein said valve means for directing said hydraulic fluid comprises a solenoid valve.

4. The cupholder of claim 1 wherein said hydaulic means further comprises a filter.

* * * * *